US005090092A

United States Patent [19]

Dempsey

[11] Patent Number: 5,090,092

[45] Date of Patent: Feb. 25, 1992

[54] CARDING FLAT ASSEMBLY

[75] Inventor: Gene A. Dempsey, Lyman, S.C.

[73] Assignee: John D. Hollingsworth on Wheels, Inc., Greenville, S.C.

[21] Appl. No.: 575,848

[22] Filed: Aug. 31, 1990

[51] Int. Cl.[5] ..... D01G 15/24

[52] U.S. Cl. ..... 19/113; 19/102

[58] Field of Search ..... 19/102-104, 19/108, 110-113

[56] References Cited

U.S. PATENT DOCUMENTS

| | | | |
|---|---|---|---|
| 4,300,266 | 11/1981 | Grimshaw et al. | 19/113 |
| 4,757,575 | 7/1988 | Varga | 19/103 |
| 4,827,573 | 5/1989 | Kuehl | 19/102 |
| 4,947,522 | 8/1990 | Staehli | 19/104 |
| 4,955,111 | 9/1990 | Jagst | 19/102 |
| 4,996,745 | 3/1991 | Sutcliffe | 19/103 X |

FOREIGN PATENT DOCUMENTS

| | | | |
|---|---|---|---|
| 2604465 | 8/1976 | Fed. Rep. of Germany | 19/113 |
| 0183900 | 5/1887 | France | 19/102 |
| 0179820 | 10/1984 | Japan | 19/113 |
| 0139823 | 7/1985 | Japan | 19/113 |
| 0139824 | 7/1985 | Japan | 19/113 |
| 0155719 | 8/1985 | Japan | 19/111 |
| 0001585 | of 1855 | United Kingdom | 19/102 |
| 0006296 | of 1887 | United Kingdom | 19/114 |
| 0022533 | of 1895 | United Kingdom | 19/102 |
| 0870424 | 6/1961 | United Kingdom | 19/102 |
| 1499810 | 2/1978 | United Kingdom | 19/102 |
| 2029869 | 3/1980 | United Kingdom | 19/113 |

*Primary Examiner*—Werner H. Schroeder
*Assistant Examiner*—Ismael Izaguirre
*Attorney, Agent, or Firm*—Bailey & Hardaway

[57] ABSTRACT

A carding flat assembly has regenerated and reconditioned members B and junctures at end portions of the T-shaped cast iron flat member A through the provision of a slide C defining spaced ledges for sliding upon the flexible bend of the carding machine and a projection D extending inwardly of the T-shaped cast iron flat beyond the juncture having integral securement in the assembly.

1 Claim, 1 Drawing Sheet

13
11
B
10
C
23
D
E
18
A
17
16
25b
14
12
15
19
25a
25

22
20
21

27
28

CARDING FLAT ASSEMBLY

BACKGROUND OF THE INVENTION

This invention relates to a reconditioned carding flat assembly.

Carding flats as used on a flat top card have T-shaped cast iron flat members with end mountings extending outwardly from opposite ends. The end mountings at a bottom side are carried upon the flexible bend of a carding machine and upon the carrier disks on the other side. The portion of end mountings which slide upon the flexible bend have a critical relationship with the other carding elements in that settings of the toothed card clothing of the flat is maintained thereby.

Because of the wear over extended periods of time between the bottom side of the end mountings periodic reconditioning procedures are necessitated. The bottom sliding surfaces of the end mountings include ledges longitudinally aligned with said flats and spaced by a concave arcuate portion, so that when the ledges become worn, reconditioning is required which includes regrinding of the end mountings to redefine the ledges. Repeated regrindings cause the end mountings to become thin with eventual loss of structural integrity. Efforts have been made to provide plastic inserts on the bottom sides of the end mountings but such have failed to take into account weakness at a juncture between the end mountings and the T-shaped cast iron flat members.

Accordingly, it is an important object of this invention to provide a carding flat assembly capable of repeated reconditioning operations with regrinding providing structural integrity in the assembly.

Another important object of the invention is to provide a carding flat assembly which after reconditioning permits repeated further reconditionings without loss of structural integrity.

SUMMARY OF THE INVENTION

A carding flat assembly equipped for reconditioning includes the usual substantially T-shaped cast iron flat member which has an end mounting integrally connecting and extending outwardly from each end. The end mounting and the T-shaped cast iron frame member have a recess extending across a juncture therebetween for accommodating a slide having an arcuate recess defining spaced ledges for sliding upon the flexible bend of the carding machine defining a setting between the card clothing of the flat and the cylinder. A projection extends integrally from the slide and across the recess portion within the cast iron flat member bridging the juncture between the end mounting and the cast iron flat member providing structural integrity and assuring a proper setting with the card clothing.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figures 1, 2, 3:
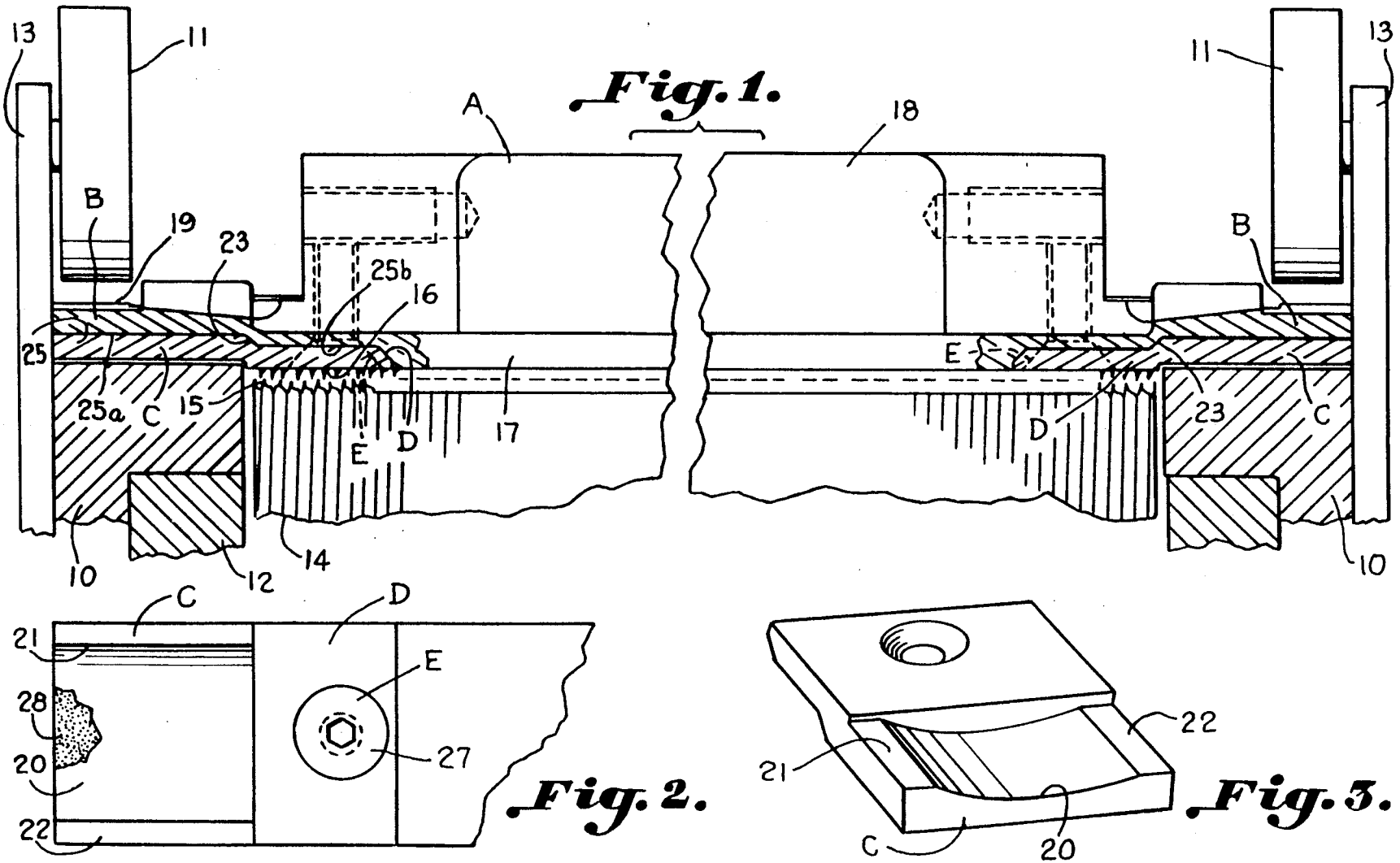
FIG. 1 is a schematic front elevation illustrating a carding flat assembly constructed in accordance with the present invention carried upon the flexible bends of a carding machine in carding relation with the main cylinder.
FIG. 2 is a bottom plan view of the slide and projection which is integral therewith bridging the end mounting and the T-shaped cast iron flat member.
FIG. 3 is a perspective view looking toward the end of the end mounting and slide in FIG. 2.

The drawings illustrate a carding flat assembly carried upon the flexible bends beneath the carrier disks of a carding machine. A substantially T-shaped cast iron flat member A includes a casting having an integral flange carrying toothed card clothing on a bottom side thereof. An end mounting B extends outwardly from each end of the T-shaped cast iron flat member carried upon the flexible bend on a bottom side and upon the carrier disks on the other side. A slide C has an arcuate recess defining spaced ledges for sliding upon the flexible bend supporting the flat and defining a setting for the toothed card clothing. A projection D is integral with the slide attaching the slide to the T-shaped cast iron member extending inwardly beyond a juncture of the end mounting with the T-shaped cast iron flat member. The end mounting and the T-shaped cast iron flat member have a recess extending beyond the juncture receiving the slide and the projection. Suitable means E preferably including a screw secure the slide and the projection within the recess in integral relation therewith. Thus, the end mounting and the T-shaped cast iron flat member will be reinforced against bending at the juncture and the slide and projection immovably positioned upon the assembly for providing a proper setting for the toothed card clothing.

Referring more particularly to FIG. 1, the carding flat assembly is illustrated as having sliding movement upon the flexible bends 10 beneath the carrier disks 11 of a carding machine. The flexible bends are carried upon the arch 12 of the carding machine as are the support stands 13 for the carrier disks 11. The main cylinder 14 is equipped with card clothing 15 which is in carding relation with the card clothing 16 carried by the respective flats. The flats are carried in a lower run upon the flexible bends in carding relation with the main cylinder, while the carrier disks support an upper run of a series of flats which are joined together by suitable links (not shown).

The substantially T-shaped cast iron flat member A has a casting which includes an integral flange 17 carrying suitable toothed card clothing 16 on a bottom side. The casting further includes an upstanding web member 18.

The end mounting B has a surface adapted to slide on a bottom side thereof, while the other side is provided with a surface 19 so as to be supported by the carrier disks 11. The slide C has an arcuate recess 20, FIG. 3. The arcuate recess 20 defines spaced ledges 21 and 22 which are provided for sliding movement upon the flexible bend supporting the flats so as not to rock thereon and defining a setting for the toothed card clothing of the flat with respect to the card clothing of the main cylinder. The projection D is integral with the slide and attaches the slide to the T-shaped cast iron flat member extending inwardly beyond the juncture 23 between the end mounting and the T-shaped cast iron flat member. The slide C and the projection D bridge the juncture 23 between the cast iron flat member A and the end mounting D for providing rigidity and assuring proper card settings. Suitable means E is provided for assuring a fixed rigid integral like connection between the slide C and the projection D within the recess 25. Between the end mounting and the slide and projection, the recess 25 extends between a lower relieved portion of the end mounting as at 25*a* and beneath a recessed portion 25*b* in the cast iron flat member. The connection members E includes a screw 27 and a suitable glue 28.

It is thus seen that a carding flat assembly has been provided which facilitates reconditioning of existing carding flats in such a way as to assure proper card settings and provide structural integrity at the juncture of the end mounting and the cast iron flat member.

While a preferred embodiment of the invention has been described using specific terms, such description is for illustrative purposes only, and it is to be understood that changes and variations may be made without departing from the spirit or scope of the following claims.

What is claimed is:

1. A carding flat assembly disposed upon flexible bends beneath carrier disks of a carding machine comprising:

a substantially T-shaped cast iron flat member including a casting having an integral flange with toothed card clothing mounted on a bottom side thereof and a web member at right angles thereto;

an end mounting extending outwardly from an end of said T-shaped cast iron flat member disposed upon said flexible bend on a bottom side and beneath said carrier disks on an upper side;

a slide having an arcuate recess defining spaced ledges for sliding upon said flexible bend supporting said flat and defining a setting for the toothed card clothing;

a projection integral with said slide for attaching said slide to said T-shaped cast iron member extending inwardly beyond a juncture of said end mounting with said T-shaped cast iron flat member and beneath said web;

said end mounting and said T-shaped cat iron flat member having a recess extending beyond said juncture and beneath said web receiving said slide and said projection; and fastening means securing said slide and said projection within said recess including glue between engaging surfaces of said recess, said slide and said projection;

wherein said end mounting and said T-shaped cast iron flat member are reinforced against bending at said junction and said slide and projection immovably positioned upon said assembly providing a proper setting for said toothed card clothing.

* * * * *